United States Patent [19]

Ishioka

[11] Patent Number: 5,060,758

[45] Date of Patent: Oct. 29, 1991

[54] EMERGENCY DESCENDING DEVICE

[75] Inventor: Shigeo Ishioka, Mie, Japan

[73] Assignees: TBR Corporation, Toyokawa; Daitoh Stainless Kaihsydu Center Co., Ltd., Nagoya; Iida Machine Works Limited, Iida, all of Japan

[21] Appl. No.: 359,653

[22] PCT Filed: Dec. 25, 1987

[86] PCT No.: PCT/JP87/01030

§ 371 Date: May 18, 1989

§ 102(e) Date: May 18, 1989

[87] PCT Pub. No.: WO88/04942

PCT Pub. Date: Jul. 14, 1988

[30] Foreign Application Priority Data

Dec. 28, 1986 [JP] Japan ..... 61-315843
Apr. 10, 1987 [JP] Japan ..... 62-89570

[51] Int. Cl.[5] ..... A62B 1/14

[52] U.S. Cl. ..... 182/234; 182/239; 188/65.4

[58] Field of Search ..... 182/234, 239, 5, 6, 182/7; 188/65.4

[56] References Cited

U.S. PATENT DOCUMENTS

| | | | |
|---|---|---|---|
| 827,510 | 7/1906 | Davy | 182/239 |
| 2,976,955 | 6/1958 | Huber . | |
| 3,777,856 | 12/1973 | Gardner | 182/5 |
| 3,799,287 | 3/1974 | Ledner | 182/5 |
| 3,826,341 | 7/1974 | Ledner | 182/5 |
| 3,946,989 | 3/1976 | Tsuda | 182/5 |
| 4,359,139 | 11/1982 | Bloder | 182/234 |
| 4,662,475 | 5/1987 | Rutschi | 182/5 |

FOREIGN PATENT DOCUMENTS

| | | |
|---|---|---|
| 59-139276 | 8/1984 | Japan . |
| 60-85761 | 5/1985 | Japan . |
| 60-99271 | 6/1985 | Japan . |
| 61-141376 | 6/1986 | Japan . |
| 62-90177 | 4/1987 | Japan . |
| 62-127066 | 6/1987 | Japan . |
| WO84/02850 | 8/1984 | PCT Int'l Appl. . |
| 702613 | 1/1954 | United Kingdom . |

*Primary Examiner*—Reinaldo P. Machado
*Attorney, Agent, or Firm*—Wenderoth, Lind & Ponack

[57] ABSTRACT

An emergency descending device comprising a rotary wheel and a cam mounted between a pair of side plates, with a main rope passing between the rotary wheel and the cam. The rotation of the rotary wheel caused by the main rope generates a centrifugal force on a brake shoe, and the brake shoe tends to rotate a brake drum. The rotation of the brake drum rotates the cam toward the rotary wheel thereby clamping the main rope therebetween, and suitable descending speed can be obtained.

8 Claims, 5 Drawing Sheets

FIG.15
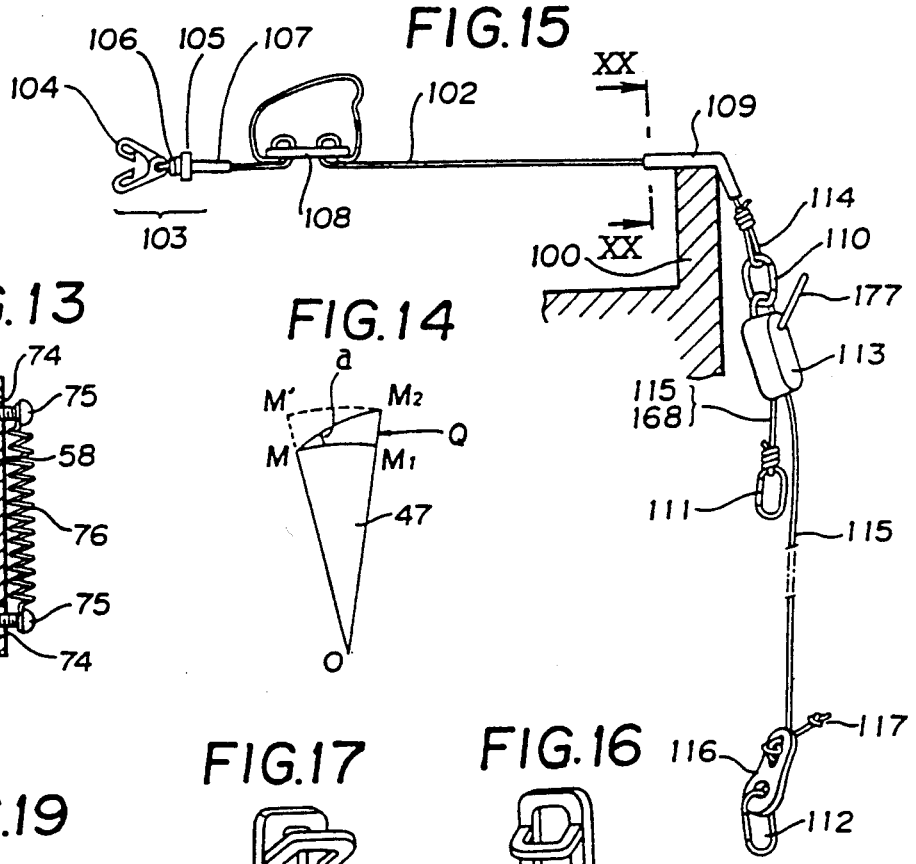
FIG.13
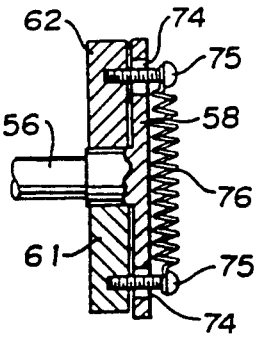
FIG.14
FIG.19
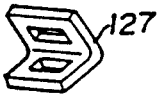
FIG.17
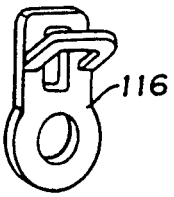
FIG.16
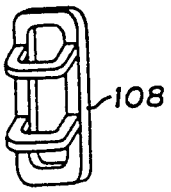
FIG.18
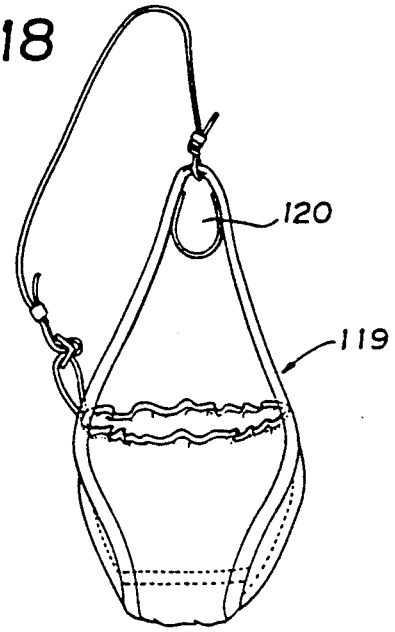
FIG.20
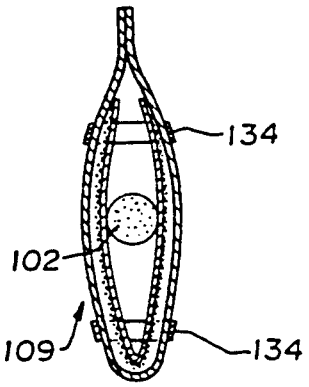

EMERGENCY DESCENDING DEVICE

DESCRIPTION

1. Technical Field

The present invention relates to a device which enables a person safely descending from a high location, and particularly, to an emergency descending device for safely carrying a person out of a high stored building onto the ground in case of emergency such as fire and the like.

2. Background Art

It will sometimes be required to escape out of a window or the like of two or more stored building or to escape from a high level road in case of earthquake, fire and the like. An emergency descending device for a traveler is required to satisfy following items, namely, (1) it is small in the size, and light in the weight such that the device can be packed in a portable case;

(2) the device shall be used where there is not any means provided on the building for connecting one end of a rope of the descending device; in such case the device shall satisfy that (a) it can easily be connected to some object fixed to the building, (b) when the rope is connected to a movable object such as a desk or the like and the person starts to descend, then, the object may be caught by some obstacles such as a window frame or the like after moving some amount which abruptly stops the descending movement thereby causing a swoon of the descending person or cutting the rope, and accordingly, the device shall incorporate shock absorbing means for preventing aforesaid discrepancies;

(3) the descending speed is automatically controlled so that a sick person or a child can safely descend;

(4) a child of such as the weight of 25 kg and a heavy person such as 150 kg weight can safely descend;

(5) there is provided means for protecting the rope from damages caused of edges on the window frame or the like;

(6) there is provided a safety belt for comfortably and safely support the person without preventing the use of both hands of the descending person;

(7) the rope shall have heat resisting characteristics;

(8) the device shall permit the movement of the rope in the opposite directions;

(9) the device can easily be handled by feeling in the dark and can safely descend the person;

(10) a person can safely descend together with a child being held in arms;

(11) the device can be handled by a single person, and

(12) the device can be used in rain or cold weather.

Similar characteristics are also required for use in a rescue operation of a rescue team. Particularly, it is important that the device is compact and light weight, and that the operation is automatic. For example, when a building is in fire and persons failed to escape ask for help through windows, the rescue team may carry a plural sets of the descending devices and deliver each set to each person so that the person can handle the device by himself and descend safely from the building. The rescue team may also descend lastly by utilizing respective descending devices for themselves. In such case, the devices for the rescue team are preferably of the type having a speed adjusting lever for selecting automatic or manual operation and stopping the descending movement in the manual operation with one's hands free whereby the rescue team can assist, by stopping the device of himself and by utilizing both hands, other person whose descending movement has been disturbed by some reasons such as a projecting portion of the building.

The inventor has disclosed in Japanese Patent Application 58-013595 a small sized and light weight device incorporating a speed adjusting lever which stops the device in hand free condition, and in Japanese Patent Applications 58-194695, 58-206778, 59-26469 and 60-230646 an automatic descending device with and without having a speed adjusting device and a stopping device. Further, in Japanese Patent Application 60-268089 a device permitting the movement of the rope in opposite directions which is advantageous in descending plural persons successively.

DISCLOSURE OF INVENTION

An emergency descending device usually consists of a main rope, a safety belt or body supporting means for connecting with a human body, a speed adjustor for adjusting the relative movement of the main rope, a connector for connecting the upper end of the main rope or the speed adjustor with a fixed support in the building such as a door, and a rope protector for protecting the main rope from damages caused by a sharp edge on the building or the like.

According to the present invention, the weight and the size of aforesaid elements are reduced, and particularly those of the speed adjustor are reduced. Prior art speed adjustor is of hydraulic braking type or centrifugal force braking type, and the speed adjustor of present invention belongs to centrifugal force braking type. The comparison between the speed adjustor of the invention and a prior art speed adjustor will now be explained. Both adjustors are common in that when the descending device is operating at a constant speed the main rope moves in the adjustor and rotates a rotary wheel, and rotates brake shoes engaging with the rotary wheel, which brake shoes being incorporated in a brake drum, and the centrifugal force due to the rotation of the brake shoes expand the brake shoes thereby applying the brake shoes a pressure corresponding to the speed of the main rope against the brake drum whereby the brake drum tends to rotate. In the prior art adjustor, the brake drum is secured to a housing of the adjustor and does not rotate and, accordingly, the rope is mainly braked by the frictional force between the brake shoes and the brake drum, and the centrifugal force braking mechanism is large in the size and heavy in the weight, further, a large amount of heat will generate. According to the invention, the brake drum is rotatably mounted in the housing of the adjustor and engages with a cam member being adapted to press the rope.

The following constitution according to the invention enables to reduce the size and weight of the device.

(1) The braking is applied on the rope by applying a force directly on the rope, and by bending the rope, thus, the braking effect is large as compared with the force applied directly on the rope.

(2) The cam engaging with the brake drum is performed through a pair of large and small gears whereby the cam receives a rotating force of several times of the force applied on the brake drum by the brake shoes.

(3) The configuration of the cam is determined so that the force applied on the rope is increased.

Therefore, according to the invention, a large braking force is applied on the rope even thought the brake drum receives a relatively small force from brake shoes, and the size and weight of the centrifugal force braking mechanism can be reduced, further, since a large amount of heat is carried away by the moving rope which reduces the temperature rise and heat dissipating means can be omitted. Further, by restricting the maximum rotating angle of the cam member, it is possible to restrict the force applied on the rope by the cam member, whereby the device of the invention has superior damping effects. Further, by providing a tension spring between a pair of the brake shoes, it is possible to prevent variation of the speed in a low speed condition and to attain stable descending movement at a light load.

BRIEF DESCRIPTION OF DRAWINGS

FIG. 13 is a schematic cross sectional view taken along line XIII—XIII in FIG. 12;

FIG. 14 is a partially broken view of a cam member and showing the operation of the cam member;

FIG. 15 shows a reciprocating type emergency descending device according to a second embodiment of the present invention and being hanged on a window;

FIG. 16 and FIG. 17 are respectively perspective views of rope adjustors of the device of the invention;

FIG. 18 is a perspective view of a body holding implement of the device of the invention;

FIG. 19 is a perspective view of an implement for adjusting a shoulder belt according to the invention;

FIG. 20 is a cross section of the rope protector and being taken along line XX—XX in FIG. 15;

BEST MODE FOR CARRYING OUT THE INVENTION

Figure 4:
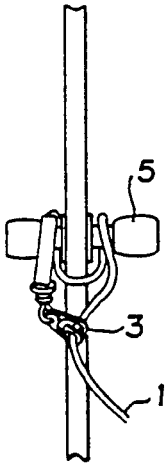
FIG. 4 shows a hook constituting a part of the emergency descending device according to the invention and being connected to a knob of a door.
Figure 5:
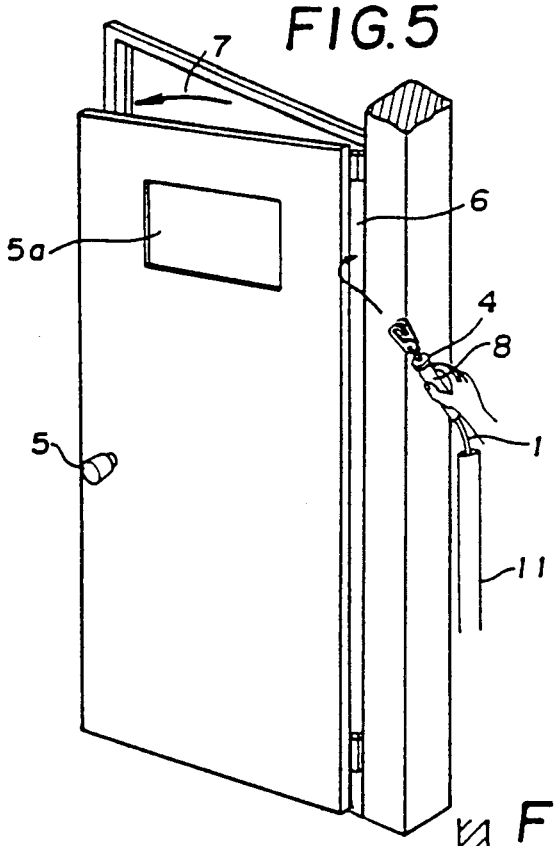
FIG. 5 shows a clearance restricting implement located in a clearance between a door and a structure.
Figure 6:
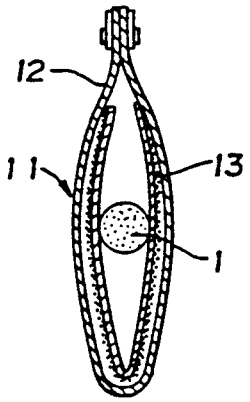
FIG. 6 is a sectional view of a rope protector.
Figure 7:
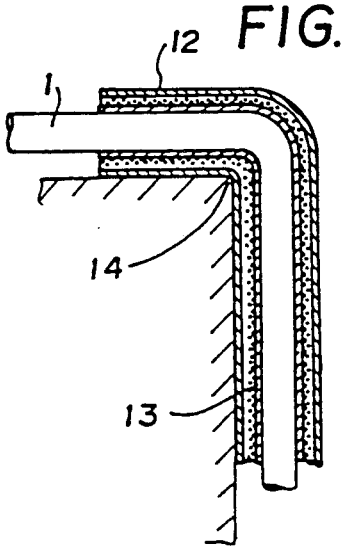
FIG. 7 is a sectional view of the rope protector engaging with an edge of a window frame.
Figure 8:
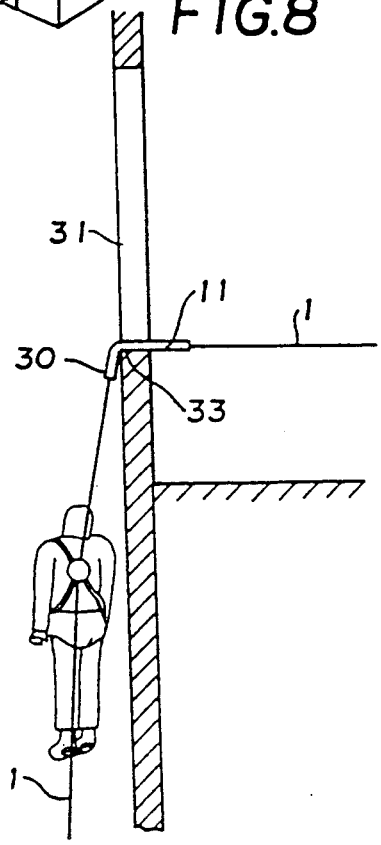
FIG. 8 is a schematic view showing a user of the emergency descending device escaping out of a window.

An emergency descending device according to a first embodiment of the present invention will now be described in connection with the drawings. The device consists of a device shown in FIG. 1 and a case 10 shown in FIG. 2 for receiving the device. The device shown in FIG. 1 comprises a main rope 1 which, in the embodiment, is a dual construction (core and skin) polyamid fiber with the outer diameter of 4.3 mm and the tensile strength of about 1 ton so as to reduce the weight and to improve the heat resisting characteristics. The rope deteriorates by the direct sun, however, the time period exposed to the direct sun is relatively short, thus, it is not required to consider such inferiority. However, the case 10 is of light shielding characteristics (when the case 10 is formed of fabrics, a rubber lining or the like should be provided.) Shown at reference numeral 2 is a connector for connecting the rope 1 with a fixed support provided in such as a room, and consists of a pair of hooks 3 and a clearance restricting implement 4. Shown at 1*a* is a knot of the rope 1. The hooks 3 are connected to such as a knob 5 of a door as shown in FIG. 4 or to a leg of a bed and the like. FIG. 5 shows the clearance restricting implement 4 which is inserted through the clearance 6 or 7 between a door and a fixed structure as shown in broken lines arrows and by closing the door a fixed support for the descending device can be formed. A relatively rigid pipe 8 is advantageously utilized in inserting the implement 4 through the clearance. The door is preferably locked for preventing incidental opening of the door. Other doors in the room may also be utilized, or the door may be tied up by the rope. If necessary, break a glass 5*a* in tying up the door by the rope. Usual construction of the door will sufficiently serves as the fixed support for the descending device by the technique shown in FIG. 4 or FIG. 5. When there is not any suitable fixed support, the rope may be connected to a desk and the like which is larger than the opening of a window frame. Shown at 9 is a speed adjustor which is explained hereinafter. Shown at 11 is a rope protector for protecting the rope from such as an edge of the window frame and the like, and is displaceable relative to the rope. The details of the rope protector 11 is shown in FIGS. 6 and 7. Shown at 12 is a cover formed of a waterproof cloth, and at 13 is a flexible sheet (preferably and abrasive cloth of AA-80 on the marked and the like) having thereon hard particles (such as emery) uniformly and closely secured thereto. When the main rope 1 tends to escape out of the sheet 13 it is preferable to clamp the sheets 13 by utilizing staples 134 and the like as shown in FIG. 20. FIG. 7 shows the rope protector 11 is protecting the rope 1 against an edge 14 on the structure. A crack may occur in the sheet 13, but the hard particles on the sheet 13 tightly contact with each other thereby preventing the edge 14 from entering into the sheet 13 thereby preventing the decrease in the strength of the rope 1. The weight of the rope protector 11 of 30 cm length is about 30 g. A body holding implement 16 of a trunks type is connected to the speed adjustor 9 through a connecting shaft 15. The implement 16 comprises a hips belt 19 and a shoulder belt 17, one end of which being connected to a shoulder belt inserting opening 28 in the speed adjustor 9 and the other end being connected to a shoulder belt adjustor 20 which, in turn, connected to the speed adjustor 9. The shoulder belt adjustor 20 is similar to that shown in FIG. 20. A family belt connecting portion 21 is also provided so that a person can descend with his child wearing similar body holding implement (not shown) of trunks type and being connected to the portion 21. Shown at 22 is a pocket provided on the implement 16 and, in the drawing, a reel 23 of the rope 1 is received in the pocket 22. A trunks 16*a* constituting the main body of the implement 16 has an elastically expandable opening 27 having sewed in rubber tape, supporting members 24 and 25 of relatively rigid (such as synthetic resin) material with the length of about 7 cm and the diameter of about 5 mm and being sewed in opposite sides of the opening 27 so that the person can easily wear the implement 16 in emergency. Shown at 26 is a grip ring to assist the wearing operation. As compared with prior art body supporting implement, the implement is advantageous as follows. When a person is supported at armpits, it is not comfortable, and the support is not reliable since the implement may slip out when the arms are raised. It is preferred to use a wide belt supporting the hips of a person, in such case, a relatively thin (such as Nylon cloth) belt has sufficient strength and reduces the weight, however, a wide (about 5 cm) and thin (about 2 mm) belt may deform into a strip like form and gnaw into the body of the person. The trunks like configuration can avoid such discrepancies. The shoulder belt 17 maintains the head of the person in the upward attitude. The implement 16 is about 150 g weight and packed into a fist size. The implement 16 can support about 2 tons of load. One end of a connecting tape 29 is secured to the main belt 18, and the other end is connected to the rope protector 11 through engaging means 30 which is released when a predetermined tension is applied. When the person escapes through a window 31 of a building as shown in FIG. 8, the engaging means 30 is released automatically with the rope protector 11 being remained on an edge 33 of the window 31 whereby the rope 1 is protected from damages caused of the edge 33.

Figure 1:
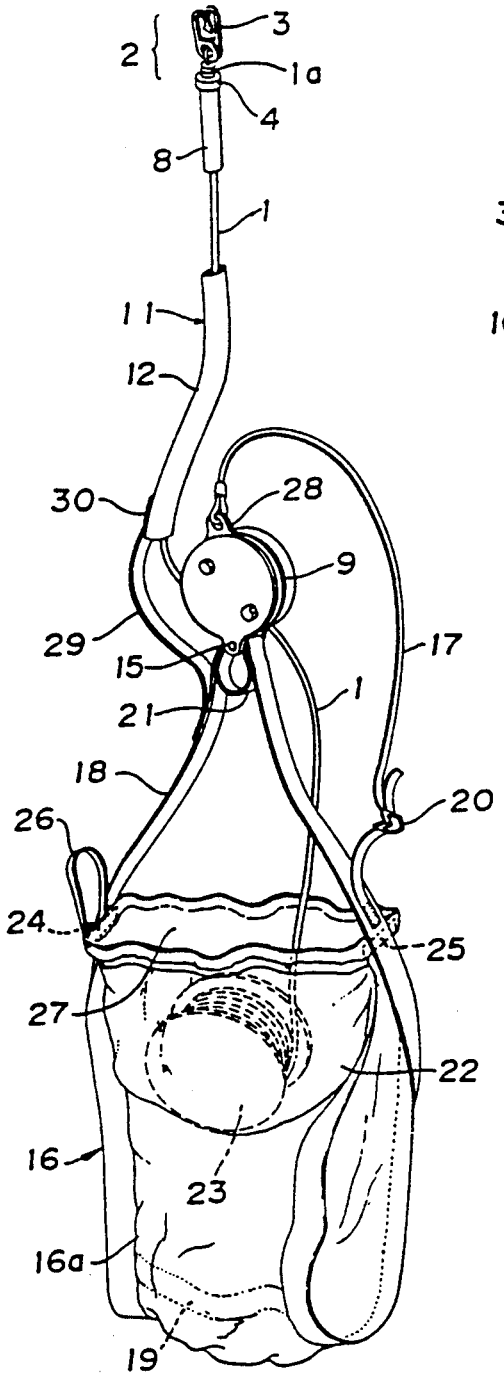
FIG. 1 shows an emergency descending device according to a first embodiment of the present invention.
Figure 2:
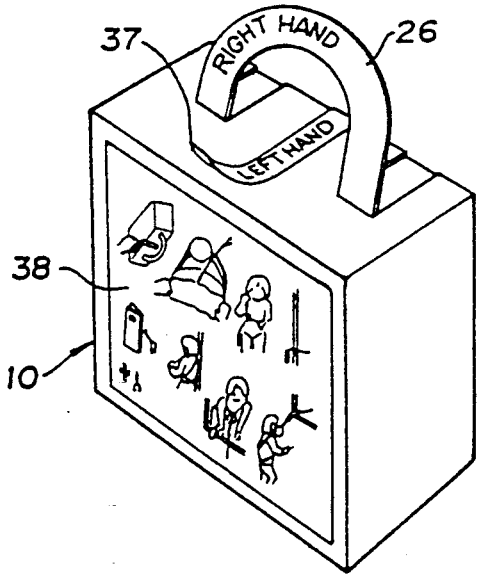
FIG. 2 and FIG. 3 show respectively cases for receiving the device of FIG. 1.
Figure 3:
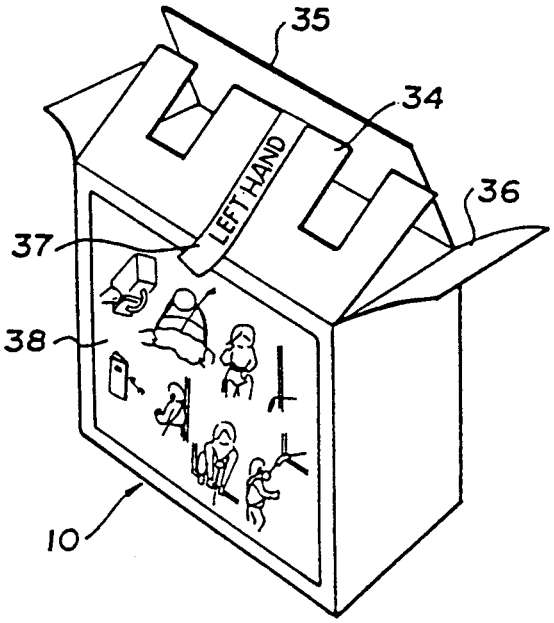

The case 10 will be explained referring FIGS. 2 and 3. Upper flaps 34, 35 and 36 are open in FIG. 3. One end of a hand grip 37 is secured to the upper flap 34 and the other end is separated. The hand grip 37 has wording "Left Hand" described thereon. The device of FIG. 1 is received in the case 10, preferably by the procedure indicated on the bottom of the case 10, so that the device can smoothly be taken out of the case 10, and, thereafter, the upper flaps are closed with a portion of the hand grip 26 projecting out of the case 10 as shown in FIG. 2. The case 10 is retained by suitable retaining means (not shown) in the closed condition. In utilizing the device, grip the hand grip 26 projecting out of the case 10 by the right hand and grip the hand grip 37 by the left hand, and pull both hands in the left and right directions, whereby the device can be taken out of the case 10. The trunks 16*a* can easily be worn with the right hand of the user gripping the hand grip 26 and the left hand gripping the portion 25 of the opening 27. Then, the shoulder belt 17 hang on the shoulder. The length of the shoulder belt 17 is preferably adjusted to the user by the shoulder belt adjustor 20. Shown at 38 is an illustration indicating emergency procedure of the device so that the user can correctly use the device by feel in the dark. The reel 23 is dropped through a window. Thereafter, the clearance restricting implement 4 is secured between a door and a wall and, as shown in FIG. 8, the user escapes out of the window. The clearance restricting implement may firstly be secured to the door or the like. The weight of the embodiment including 550 g of the speed adjustor and 20 m long of the main rope 1 is about 1.2 kg.

The speed adjustor 9 will be described referring FIGS. 9 through 14. Shown at numeral 39 is a housing, at 40 is a first side plate and at 41 is a second side plate. Shown at 42 is a first rope bending shaft, at 43 is a second rope bending shaft and at 15 is a connecting shaft, the shafts respetively consist of rings 44 and rivets 45 and are secured to the side plates 40 and 41, and maintain the space between the side plates constant. A cam shaft 46 is rotatably supported on the side plates 40 and 41 and is secured to a cam member 47, a large gear 48 and a speed adjusting lever 49. A slot 53 formed in the lever 49 receives a slider 54 to move therealong. When the lever 49 is moved in the counter clockwise direction, the slider 54 contacts with the second side plate 41 to restrict the rotation of the lever 49. A cutout 55 is formed in the second side plate 41 such that, when the person operates the speed adjusting lever 49 and pushes the slider 54 by his thumb, the slider 54 engages with the cutout 55. A stop 51 is secured to the large gear 48 and when the slider 54 engages with the second side plate 41 the stop 51 contacts with a brake drum 65. A rotary shaft 56 is rotatably mounted on the side plates 40 and 41, and a rotary wheel 57 and a shoe supporting plate 58 are secured to the shaft 56. The rotary wheel 57 has in the circumference slip preventing grooves 52. Two shoe supporting rods 59 and 60 are secured to the shoe supporting plate 58 for pivotally supporting brake shoes 61 and 62 respectively. Brake linings 63 and 64 are respectively mounted on the brake shoes 61 and 62. The brake drum 65 is located outside of the brake shoes 61 and 62 and is rotatably mounted on the rotary shaft 56. A small gear 66 is secured to the brake drum 65 and engages with the large gear 48. Shown at numeral 74 in FIG. 13 are openings formed in the shoe supporting plate 58 for loosely passing therethrough two spring supporting screws 75 which, in turn, are secured to brake shoes 61 and 62 respectively. A low speed control spring 76 extends between the spring supporting screws 75.

Figure 9:
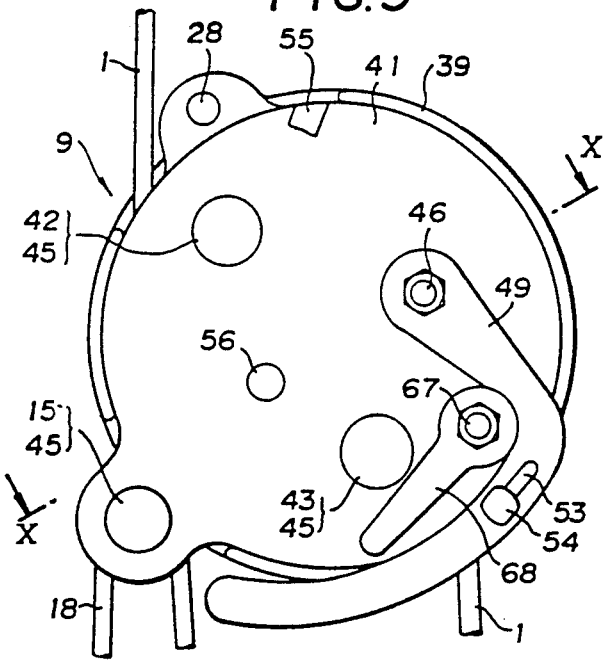
FIG. 9 is a front view a speed adjustor as viewed from the left side of FIG. 10.
Figure 10:
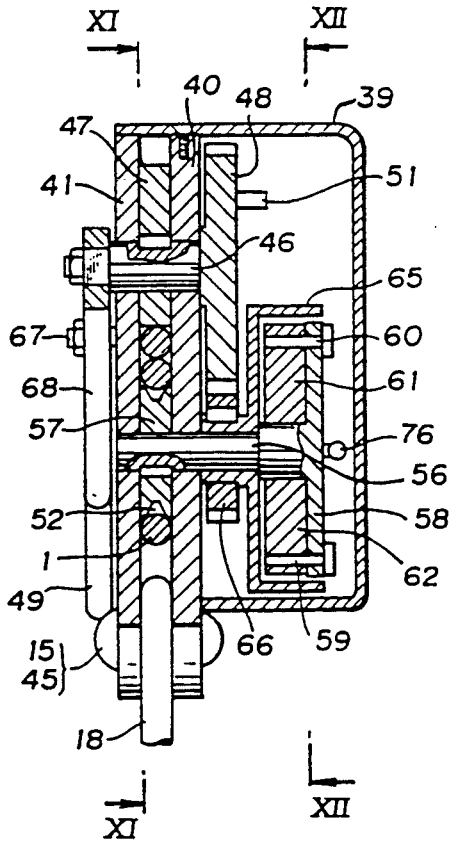
FIG. 10 is a longitudinal sectional view taken along line X—X in FIG. 9.
Figure 11:
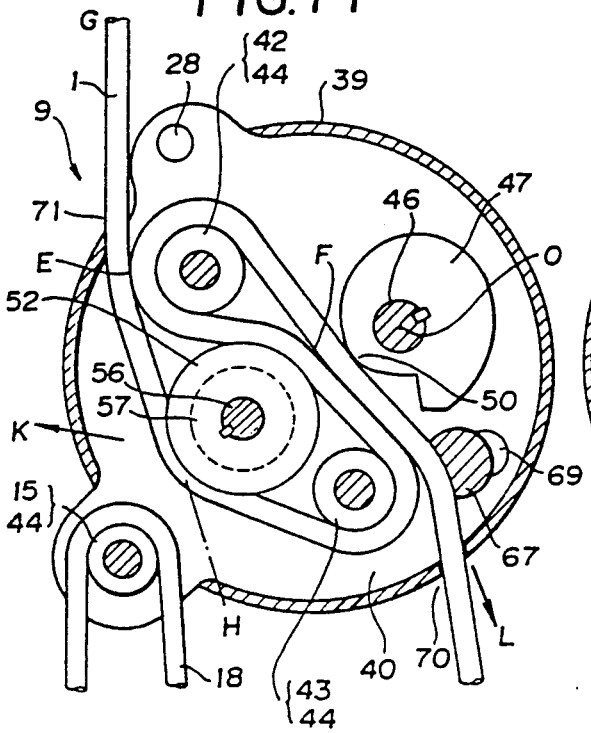
FIG. 11 is a cross sectional view taken along line XI—XI in FIG. 10.
Figure 12:
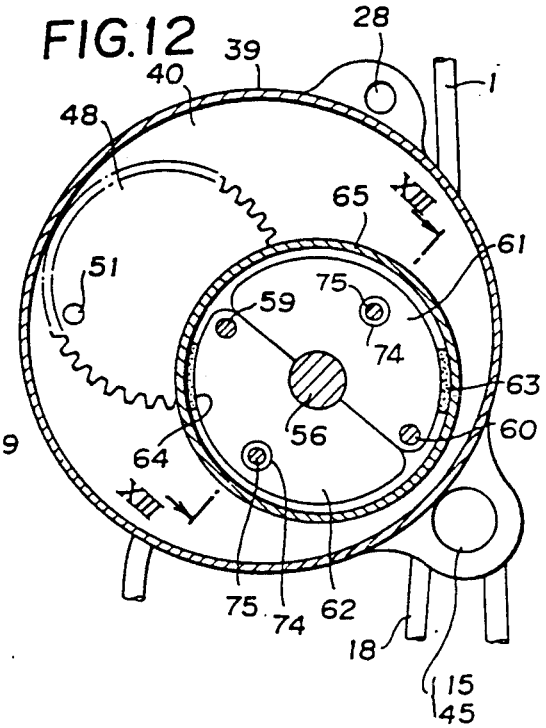
FIG. 12 is a cross sectional view taken along line XII—XII in FIG. 10.

A select lever 68 for selecting automatic or stop is secured to a select shaft 67 as shown in FIG. 9, and the select shaft 67 is pivotally mounted on the side plates 41 and 42. An eccentric portion 69 is formed on the shaft 67 so that when the select shaft 67 is rotated by the lever 68 a large pressure is applied on the rope 1 by the eccentric portion 69. The rope 1 engages with the speed adjustor 9 as shown in FIG. 11. Namely, the rope 1 enters into the adjustor 9 through a portion 70 and leaves out through a portion 71. The rope 1 contacts at locations E and F with each other to generate pressure. A suitable angle is formed between line GE and line EH. (This angle determines the braking force and, when the temperature is −40° C. or less the angle is preferably 180° and, at that time, the rope 1 does not contact at the location E.)

The configuration of the cam member 47 will now be described. When the speed adjusting lever 49 takes the position shown in FIG. 9, the clearance between the rotary wheel 57 and the cam member 47 is the maximum, and the cam member 47 does not apply any force on the rope 1. When the speed adjusting lever 49 rotates from the position of FIG. 9 in the counter clockwise direction the clearance between the rotary wheel 57 and the cam member 47 descreases gradually and the pressure applied on the rope 1 increases. When the lever 49 is rotated to the position whereat the slider 54 of the lever 49 is located in the cutout 55 in the second side plate, the pressure applied to the rope 1 increased to the maximum. The distance between the periphery of the cam member 47 and the center 0 of the pivotal movement of the cam member 47 is the minimum at point 50, and increases along the periphery in the clockwise direction, however, the increment gradually decreases due to the reason which will be explained hereinafter.

The operation of the speed adjustor 9 will now be explained. In FIG. 11, when the upper end G of the rope 1 is secured to a support (not shown) and a load is applied on the connecting shaft 15, the load and the speed adjustor 9 move downward, and the rotary wheel 57 rotates in the clockwise direction due to the friction on the rope 1. The shoe supporting plate 58 rotates due to the rotation of the rotary wheel 57, and causes on the brake shoes 61 and 62 the centrifugal force. Brake linings 63 and 64 applies pressure on the brake drum 65. A rotational force acts on the brake drum 65 due to the friction between the brake drum 65 and brake linings 63 and 64. The small gear 66 rotates the large gear 48, and the cam member 47 rotates in counter clockwise direction and applies pressure on the rope 1. The reaction of the rope 1 impedes the rotation of the cam member 47. Since the rope 1 slides on the surface of the cam member 47 the friction therebetween acts on the cam member 47 the rotational force in the clockwise direction. The rotation of the cam member 47 in the counter clockwise direction will terminate soon. The rotation of the brake drum 65 terminates with brake linings 63 and 64 rotating so that the rotational force in the counter clockwise direction on the cam member 47 is maintained. The centrifugal force and the pressure transmitted to the rope 1 from the cam member 47 will correspond to the descending speed of the load. When the pressure applied on the rope 1 from the cam member 47 increases, the breaking force acting on the rope 1 increases and the load will descend slowly. Thereforce, the descending speed of the load is limited to a predetermined speed. When the descending speed of the load is decreased, the centrifugal force decreases and the torque acting on the cam member 47 in the counter clockwise direction also decreases. The friction between the rope 1 and the cam member 47 acts to rotate the cam member 47 in the clockwise direction whereby the pressure acting on the rope 1 decreases and the descending speed increases. As the result, the descending speed is maintained nearly constant. Further, the rope 1 can easily be pulled in K or L direction (the force is about 2 Kg) by one's hand, which enables to adjust the length of the rope extending out of the speed adjusting device in connecting the rope to a fixed support on the structure.

The manual adjusting of the descending speed will be explained. When it is required to adjust the descending speed, the speed adjusting lever 49 is actuated. When the lever 49 is moved until the slider 54 contacts with the second side plate 41. When the slider 54 is pushed into the cutout 55, the device maintains the standstill condition without gripping the speed adjusting lever 49. The selection between manual and automatic operations will be explained. In FIG. 11, the eccentric portion 69 of the select shaft 67 does not contact with the rope 1 in the automatic operation, however, when the select lever 68 is turned in the left or right direction at a large force, the eccentric portion 69 will hardly press the rope 1 and stops the descending movement. It may be considered that the speed adjusting mechanism 46, 47, 48 and 49 can omit the selecting mechanism 67, 68 and 69, however, the user of the device will sometimes not able to actuate correctly the speed adjusting lever 49, in such cases, the mechanism 67, 68 and 69 is preferable. Therefore, the speed adjusting lever 49 and the selecting mechanism preferably provided as optional equipments, which are particularly adapted for use in a rescue team. When there is a large slack on the rope 1 the initial descending speed may excessively increase due to the free fall in starting the descending, with the cam member 47 rotates in the counter clockwise direction in FIG. 11, and the slider 54 contacts with the second side palte 41. When the speed adjusting lever 49 is not provided, the stop 51 contacts with the brake drum 65. The rotation of the cam member 47 in the counter clockwise direction will terminate and the force transmitted to the rope 1 from the cam member 47 is restricted to a predetermined value, thus, the tension acting on the rope 1 is restricted to a predetermined value (e.g. about 200 kg) and the descending speed of the device decreases rapidly. The centrifugal force will decrease with the cam member 47 rotating in clockwise direction in FIG. 11, and the device is in automatic operation.

The low speed stabilizing spring 76 will be explained referring FIG. 13. When the rotary wheel 57 is not rotating, the linings 63 and 64 may contact with the brake drum 65 due to the dead weight of the brake shoes 61 and 62 whereby the initial descending speed will disperse largely. Further, when the load is relatively small and, accordingly, the descending speed is small, the dead weight of brake shoes 61 and 62 affects on the force acting on the brake drum 65 by the linings 63 and 64 may disperse whereby the descending speed may change and the device will sometimes stop. When the load is heavy and the descending speed is large, the centrifugal force is large and the effect of the dead weight of brake shoes 61 and 63 can be neglected. The low speed stabilizing spring 76 acts to pull brake shoes 61 and 62 toward the rotary shaft 56 thereby preventing linings 63 and 64 from contacting with the brake drum 65 due to the dead weight of brake shoes 61 and 62; and to remove the aforesaid adverse effects in the start condition and low speed condition. Further, the force required in pulling the rope 1 in K or L direction as viewed in FIG. 11 from the speed adjustor 9 can be reduced. The cam member 47 will further be explained. In FIG. 14, it is denoted that the center of pivot movement of the cam member 47 is 0, a contact point between the cam member 47 and the rope 1 is M, a circular arc with the center being 0 and the radius being OM is $MM_1$, and a curved line extending along the periphery of the cam member 47 is $MM_2$. The angle of inclination of the cam member 47 at point M is denoted by angle $\alpha$. The descending load is assumed as $W_1$ kg in FIG. 14, and the force of P Kg is transmitted to the rope 1 from the cam member 47 at point M. When the load is increased from $W_1$ to $W_2$ the force P is required to increase from P to $P+\Delta P$. The cam member 47 rotates in counter clockwise direction to compress the rope 1 by MM'. The work applied on the rope 1 by the cam member is $[P+(P+\Delta P)]\times(MM')\div 2$. In assuming $M_1M_2=MM'$ and $OMM_2$ as a corollary, the corollary rotates in counter clockwise direction by the force Q and compresses the rope 1 by MM'. The descending movement generates a centrifugal force, and a moment of counter clockwise direction will generate on the cam member 47 by the centrifugal force. By assuming N as the moment, the force $Q=N\div OM$. The work $[\{P+(P+\Delta P)]\times(MM')\div 2$ is performed by $[Q+(Q+\Delta Q)]\times(MM_1)\div 2$. When $(MM_1)$ is large or when the inclination angle $\alpha$ of the cam member 47 is small, the value of Q can be reduced. Namely, the increase in the descending speed required to obtain $(P+\Delta P)$ for enabling the increase of W can be reduced when the inclination angle $\alpha$ is small. Therefore, as compared with a cam having a uniform increment in the inclination angle, the cam member 47 according to the invention has a large increment near to the point 50 in FIG. 11 and the increment gradually decreases in departing from the point 50, thus, when the load is light the descending speed is relatively large and when the load is heavy the descending speed is relatively small. Further, in case of heavy load and large descending speed, it is required to enlarge brake shoes by utilizing the cam of uniform increment, but the cam member of the invention does not require to generate large braking force, whereby the size and weight of the speed adjustor can be minimized. The cam member 47 of the invention enables to expand the range of the load for attaining suitable descending speed. (Japanese Fire Protection Law stipulates that the descending speed of a slow descender or a personal descending device shall be in the range between 16 cm and 160 cm per second.) The device of the invention is applicable to the load between 25 kg and 150 kg. Further, the device of the invention operates reliably at a suitable descending speed with the rope and the device dipping in water, and also at ambient temperature of −20° C.

Another feature of the invention resides in that the rope passes between the cam member 47 and the rotary wheel 57 such that when the cam member 47 rotates the rope receives the pressure from both members 47 and 57. Following advantages are obtained. When the load is increased and the work rotating the rotary wheel 57 is increased a slip may generate between the rope 1 and the rotary wheel 57, however, according to the invention, the rope 1 is clamped between the cam member 47 and the rotary wheel 57, thus, when the load is increased and the force of the cam member 47 pushing the rope 1 is increased the force of the rope 1 pushing the rotary wheel 57 is also increased, whereby the slip between the rope 1 and the rotary wheel 57 can be prevented. As shown in FIG. 11, the rope 1 receives the pressure from both of the cam member 47 and the second rope bending shaft 43 during the rotation of the cam member 47 due to the positional relationship of the cam member 47, the rotary wheel 57 and the second rope bending shaft 43. Accordingly, by locating suitably the position of the second rope bending shaft 43, it is possible to prevent the slip between the rotary wheel 57 and the rope 1 and to prevent the rotary wheel 57 from receiving an excessive force from the cam member 47. According to one embodiment of the invention, the cam member 47 and the rotary wheel are separated sufficiently so that the rope 1 receives adjusted pressure between the cam member 47 and the second rope bending shaft 43. According to one modified form of the invention, a knurl machining process is applied on the rotary wheel 57 instead of the groove 52. The second rope bending shaft may be omitted, in such case, since the braking force on the rope 1 decreases the size of the brake shoes should be increased. Further, it is possible to increase the number of rope bending shafts for increasing the total bending angle of the rope, then, the pressure applied on the rope from the cam member can be decreased whereby the size and weight of brake shoes, the brake drum, the large gear, the small gear and the like can be reduced and, accordingly, the weight of brake shoes, the brake drum, the large gear, the small gear and the like can further be reduced. However, the force for pulling the rope through the speed adjustor in L or K direction increases, thus, such modification is advantageous in some cases.

A second embodiment of the present invention or a reciprocating type emergency descending device is shown in FIG. 15 through FIG. 25. This embodiment differs from the first embodiment shown in FIG. 1–FIG. 14 in that the rope 1 in the first embodiment moves only one direction in the speed adjustor, while in the second embodiment, the descending can be performed toward opposite ends of the rope alternately, namely, the rope can reciprocate in the speed adjustor.

FIG. 15 shows the device of the second embodiment being hung on a window frame 100. Shown at 102 is a supporting rope, at 103 is a connector for connecting the rope 102 with a fixed support in a room and consisting of a pair of hooks 104 and a clearance restricting member 105. The usage of the connector 103 is similar to the connector 2 shown in FIGS. 4 and 5. Shown at 106 is a knot, at 107 is a relatively rigid pipe secured to the supporting rope 102. Shown at numeral 108 is a rope length adjustor, at 109 is a rope protector for protecting the rope 102 from the damage caused by an edge of the window frame, the constitution and the usage of which are similar to that of the first embodiment shown and described with respect to FIGS. 6 and 7. Shown at numerals 110, 111 and 112 are connectors (such as swivel rings which are well known as mountainerring equipment), and at 114, 115, 116, and 117 are respectively a connecting knot, a main rope, a rope adjustor, and a knot. In use, the length of the supporting rope 102 is adjusted by the rope adjustor 108 so that a speed adjustor 113 is located just below the window frame. A first person connects the connector 111 to a body holding implement 119 of himself and descends. The connector 112 moves upward. The next person adjust the length of the rope 115 by using the rope adjustor 116 such that the connector 112 is located adjacent to the speed adjustor 113, then, connects the connector 112 with a body holding implement of himself and descends. The rope 115 moves through the speed adjustor 113 in the opposite directions with respect to the first person and the second person. When the second person has descended, the connector 111 will be located adjacent to the speed adjustor 113, so that a third person can easily connect his body holding implement with the connector 111 and descend safely and easily. The body holding implement 119 shown in FIG. 18 is similar to the implement 16 shown in FIG. 1 in the construction and usage. A portion 120 in FIG. 18 is connected either of connectors 111 and 112. Preferably, three sets of the body holding implement 119 are received in a case receiving the descending device of reciprocating type. Three sets are usually sufficient as a portable emergency descending device. The overall weight of the device including the support rope 102 of 6 meters long and the main rope 115 of 26 meters long is about 2.2 kg.

Figure 21:
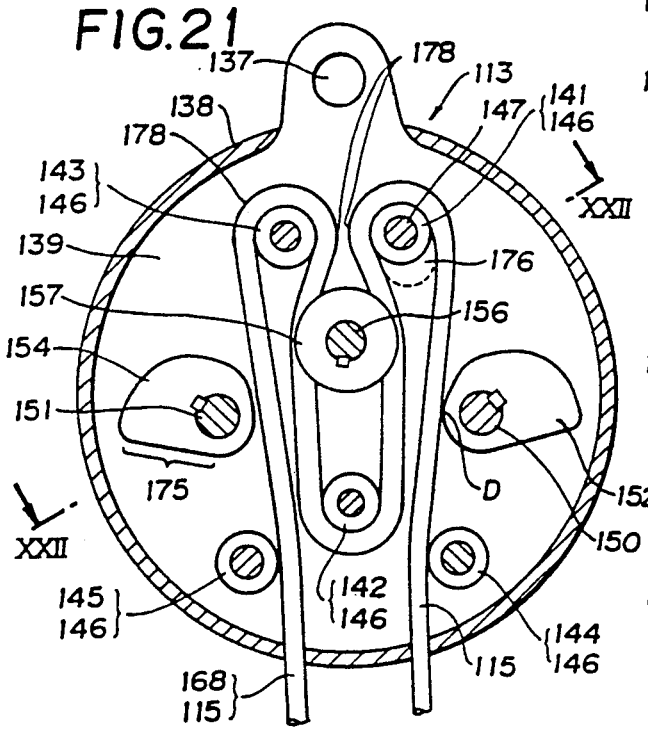
FIG. 21 is a sectional view of a speed adjustor according to a second embodiment of the invention as viewed along line XXI—XXI in FIG. 22.
Figure 22:
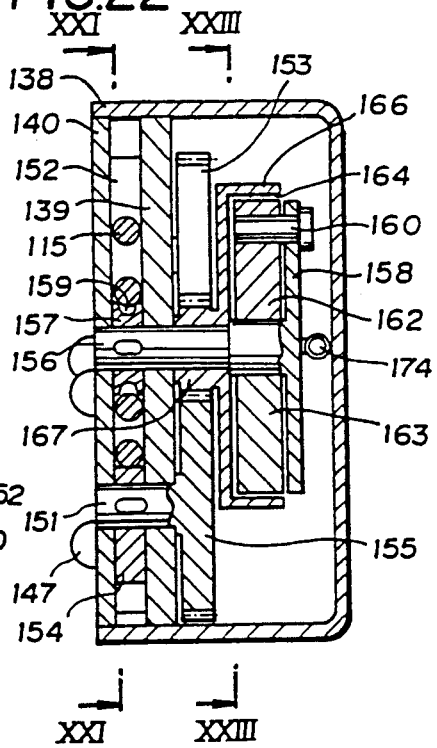
FIG. 22 is a cross sectional view taken along line XXII—XXII in FIG. 21.
Figure 23:
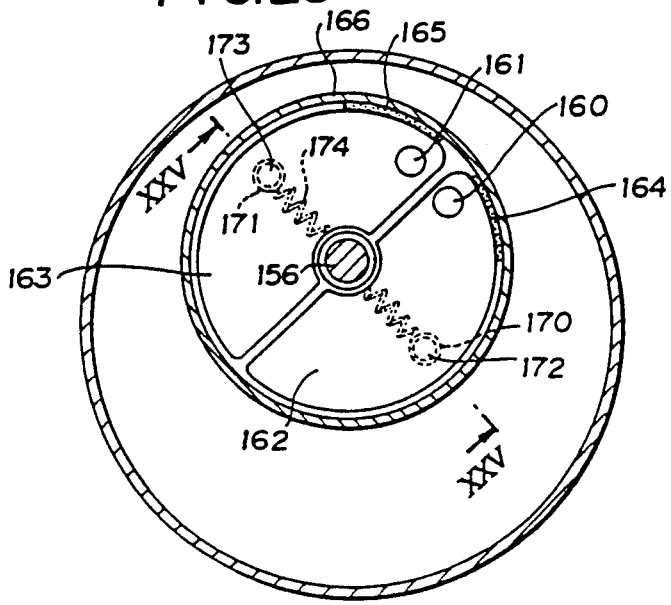
FIG. 23 is a cross sectional view taken along line XXIII—XXIII in FIG. 22.
Figure 24:
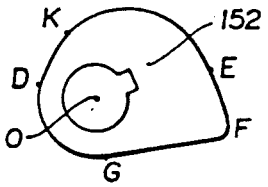
FIG. 24 is an enlarged view of first cam member shown in FIG. 21.
Figure 25:
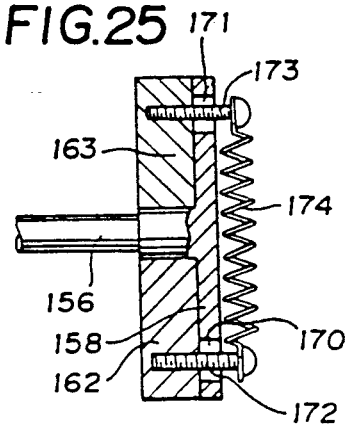
FIG. 25 is a sectional view taken along line XXV—XXV in FIG. 23 with a brake drum being removed.

The speed adjustor 113 of the second embodiment will be explained with respect to FIG. 21 through FIG. 25. Shown at 138 is a housing of the speed adjustor 113, at 139 is a first side plate, at 140 is a second side plate and, the side plates are fixed to the housing 138 with a predetermined space therebetween. A first rope bending shaft 141, a second rope bending shaft 142, a third rope bending shaft 143, a fourth rope bending shaft 144 and a fifth rope bending shaft 145 each comprising a ring 146 and a rivet 147 are secured to the side plates 139 and 140 and act to maintain the predetermined space. These shafts are arranged symmetrically with respect to the vertical center line as shown in FIG. 21. A first cam shaft 150 and a second cam shaft 151 are pivotally mounted on the side plates 139 and 140. A first cam member 152 and a first large gear 153 are secured to the first cam shaft 150, and a second cam member 154 and a second large gear 155 are secured to the second cam shaft 151. A rotary shaft 156 is rotatably mounted on the side plates 139 and 140, and a rotary wheel 157 and a shoe supporting plate 158 are secured to the rotary shaft 156. The rotary wheel 157 has grooves 159 in the periphery thereof. Shoe supporting rods 160 and 161 are secured to the shoe supporting platge 158 for pivotally mounted brake shoes 162 and 163. Brake linings 164 and 165 are secured respectively to the brake shoes 162 and 163 respectively. A brake drum 166 receiving the brake shoes 162 and 163 is rotatably mounted on the rotary shaft 156, and a small gear 167 is secured to the brake drum 166. The small gear 166 meshingly engages with the first large gear 153 and the second large gear 155. As shown in FIG. 23 and FIG. 25, openings 170 and 171 are formed in the shoe supporting plate 158, and spring supporting screws 172 and 173 secured respectively to brake shoes 162 and 163 pass respectively through the openings 170 and 171. A low speed stabilizing spring 174 extends between the spring supporting screws 172 and 173 for pulling the brake shoes 162 and 163 toward each other. The main rope 115 engages with the speed adjustor 113 as shown in FIG. 21. When a load is applied on the left side main rope 168 in FIG. 21, the rope 115 bend at the fifth rope bending shaft 145 firstly. The cam members 152 and 154 have similar configuration, but are arranged symmetrically. FIG. 24 shows details of the first cam member 152 and the point D corresponds to the point D in FIG. 21. In FIG. 24, the center angle DOE is about 130°, EOF is about 40°, FOG is about 60°, and the center angle GOD is about 130°. Assuming d is the distance between the periphery of the cam and the pivot center O, the d increases from the point D to the point F in the clockwise direction, but, in approaching the point F, the increment decreases gradually. The distance d is a constant between the point D and the point G, and changes linearly between points G and F (which will be explained hereinafter).

The speed adjustor 113 operates as follows. In FIG. 21 any load is not applied on the rope 115, and cam members 152 and 154 do not act on the rope 115. A connector 110 in FIG. 25 is connected to a connecting opening 137 in FIG. 21, and a load is applied on the rope portion 168 in FIG. 21. Then, the rope 115 moves so that the rotary wheel 157 rotates in clockwise direction due to the friction between the rope 115. The operation is somewhat similar to that of the first embodiment, thus, description will be made briefly with respet to similar portion and in detail with respect to different portion. The rotation of the rotary wheel 157 causes the rotation of brake shoes 162 and 163 which expand due to the centrifugal force, whereby a rotating force is transmitted to the brake drum 166. The rotating force is amplified by the engagement between the small gear 167 and the first large gear 153 and rotates the first cam shaft 150, whereby the first cam member 152 pushes the main rope 115. When the load is applied another portion or the right side portion of the rope, the adjustor 113 operates similarly. The second embodiment differs from the first embodiment relative to the first and second cam members 152 and 154 which will now be described. Since the cam members are connected through gears, and when the first cam member rotates in counter clockwise direction, the second cam member rotates in the same direction. During the rotation of the first cam member from point D to point E in FIG. 24, the second cam member 154 does not contact with the rope 115, thus, the second cam member 154 does not affect on the speed adjusting function of the first cam member 152. Further, when there is a free fall due to such as a slack of the main rope initially, the descending speed may increase, and the centrifugal force may increase too much such that the first cam member 152 rotates near to the poingt F in FIG. 24. The straight line portion GF of the second cam member 154 contacts with the rope 115, whereby the rope 115 is stopped. The rotation of the second cam member is stopped and the rotation of the first cam member is also stopped. And the increase in the tension of the rope is restricted. Namely, according to the embodiment, the tension acting on the rope is restricted irrespective to the feature of descend. The low speed stabilizing spring 174 acts similarly to that of the spring 76 of the first embodiment.

Some modified forms of the second embodiment will be explained. The first cam shaft 150 or the second cam shaft 151 may be modified to project through the second side plate 140 for connecting with a manually operable handle, whereby the speed can easily be adjusted including the zero speed condition. In FIG. 21, the first rope bending shaft 141 may be pivotally mounted with one end of the shaft 141 projecting out of the second side plate 140. The projecting end is connected to a select lever 177 shown in FIG. 15 so that automatic operation or braking can be selected by actuating the lever 177. Further, a stopping or braking cam 176 shown in FIG. 21 may be secured to the shaft 141 so that the cam 176 rotates and pressure is applied on portions 178 shown in FIG. 21 of the rope 115 when the select lever 177 is actuated. The mechanism enables to stop the descending person at a desired position. The lever 177 is actuated by persons remaining in the room. In the embodiment of FIG. 15, it is possible to release the connecting knot 114 from the connector 110, connect the connecting knot 114 with the connector 111 and to connect the connector 110 to the body supporting implement 119, whereby the device does not act as reciprocating type, but it is possible to actuate the lever 177 during the descend.

When one or more fixed supports are provided on a side wall of a structure, the connector 110 in FIG. 15 may be connected directly to the fixed support. In FIG. 21, the rotary wheel 157 is spaced apart from the second rope bending shaft 142, however, those members may adjacently be located similar to the rotary wheel 57 and the second rope bending shaft 43 in FIG. 11.

INDUSTRIAL APPLICABILITY

The emergency descending device according to the invention is small in size and light in weight, so that the device can advantageously used by a traveler, in a rescue operation (including an accident in a steep slope such as in mountaineering) of a rescue team. The device is inexpensive so that the device can widely and easily be equipped in two or more stored structure including a hotel, a residence, stores and the like for easily escaping out in emergency such as fire. Further, in storing the device in an automobile, it is possible to escape out of a road of high level. Further, the device can be utilized to descend a heavy weight safely.

I claim:

1. An emergency descending device comprising:
two parallel and spaced side plates,
a rotary wheel disposed between the side plates,
at least one cam disposed between the side plates,
a pair of brake shoes associated with the rotary wheel,
a brake drum associated with said cam and cooperating with said brake shoes,
at least one rope bending portion disposed between said side plates,
a main rope contacting with said rotary wheel, said cam and said rope bending portion at the location between said side plates,
connecting means provided on at least one of the side plates for connecting said device with a load or an upper fixed support, and
said main rope passing between the cam and the rotary wheel, between the cam and the rope bending portion or between the cam and the rotary wheel and the rope bending portion such that the main rope acts on the rotary wheel to expand said brake shoes thereby transmitting a rotational force to the brake drum, with the cam being rotated by said rotational force to apply a braking pressure on the main rope.

2. An emergency descending device as set forth in claim 1, wherein a single cam is provided, one rope bending portion is provided on each of upper side and lower side of a line connecting the center of the rotation of the cam and the rotary wheel, and the main rope passed between the cam and the rotary wheel from the lower side to the upper side, around the upper rope bending portion in the direction separating from the cam, again between the cam and the rotary wheel contacting with one side of the rotary wheel, between the cam and the lower side rope bending portion, around the lower side rope bending portion, in the direction separating from the cam, then contacting with opposite side of the rotary wheel and, thereafter, extends to the outside of the side plates.

3. An emergency descending device as set forth in claim 1, wherein two cams are provided symmetrically on left and right sides of the rotary wheel respectively, a pair of the rope bending portions are provided on upper side of lines connecting the center of rotation of said cams and of the rotary wheel respectively, another rope bending portion is provided lower side of the rotary wheel, a further pair of rope bending portions are provided on lower remote locations; said main rope passes between said last mentioned rope bending portions, between one of the cams and said another rope bending portion, between said one cam and the rotary wheel, around one of said first pair of rope bending portions near to said one cam and toward the other cam, again between said one cam and the rotary wheel contacting with one side of the rotary wheel, around said another rope bending portion in the direction toward the other cam, between the rotary wheel and said the other cam contacting with the other side of the rotary wheel, around the other of said first pair of rope bending portion near to said the other cam and toward said the other cam, again between said the other cam and the rotary wheel, between said last mentioned pair of rope bending portions and contacting with the other of said rope bending portions and, thereafter, extends to the outside of the side plates.

4. An emergency descending device as set forth in claim 2, further comprising a rotary shaft secured to the rotary wheel, a cam shaft secured to the cam, said brake shoes being pivotally mounted on the rotary shaft, a brake drum being loosely fitted on the rotary shaft and receiving rotatably said brake shoes, whereby when a centrifugal force acts on the brake shoe due to the rotation of the rotary wheel the brake shoes expand to transmit the rotational force to the brake drum, a small gear being secured to the brake drum, a large gear being secured to the cam shaft and engaging with said small gear, and means restricting the angle of rotation of the cam.

5. An emergency descending device as set forth in claim 4, wherein said brake shoes are pulled by a low speed stabilizing spring toward each other, and said cam has the configuration such that the distance between the center of the pivot movement of the cam and the cam surface increases gradually with the increment decreasing gradually.

6. An emergency descending device as set forth in claim 3, further comprising a rotatably provided rotary shaft being secured to the rotary wheel, a first cam shaft being secured to a first cam, a second cam shaft being secured to a second cam, said brake shoes being pivotally mounted on the rotary shaft, a brake drum being loosely fitted on the rotary shaft and receiving rotatably said brake shoes, whereby when a centrifugal force acts on the brake shoe due to the rotation of the rotary wheel the brake shoes expand to transmit the rotational force to the brake drum, a small gear being secured to the brake drum, and a large gear being secured to the cam shaft and engaging with said small gear.

7. An emergency descending device as set forth in claims 2 and 4, wherein the upper end of the main rope is connected to a support connector including a hook and a clearance restricting inplement, a rope protector is displaceably fitted on the rope and consists of a hard particles scattered sheet and a cover sheet, and a body holding inplement is connected to said connecting means, said rope protector being connected to said body holding inplement through a connection which is released under a predetermined tensile force.

8. An emergency descending device as set forth in claims 3 and 5, wherein said connecting means is connected to one end of a supporting rope with the other end being connected to a support connector including a hook and a clearance restricting inplement, a rope protector is connected to said one end of the supporting rope, a rope length adjustor is provided between said the other end and said rope protector, a connector is connected to one end of the main rope, and another connector and another rope length adjustor are connected to the other end of the main rope.

* * * * *